US007213575B2

(12) United States Patent
Moschini et al.

(10) Patent No.: US 7,213,575 B2
(45) Date of Patent: May 8, 2007

(54) FUEL MANIFOLD IN THIXOTROPIC ALUMINUM FOR THE DIRECT INJECTION OF FUEL INTO AN INTERNAL COMBUSTION ENGINE

(75) Inventors: Renzo Moschini, Bologna (IT); Gianluca Mattogno, Frascati (IT); Flavio Giovannini, Casalecchio Di Reno (IT); Stefano Poggi, Sala Bolognese (IT); Mario Casari, San Giovanni In Persiceto (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 407 days.

(21) Appl. No.: 10/817,221

(22) Filed: Apr. 2, 2004

(65) Prior Publication Data

US 2005/0056256 A1 Mar. 17, 2005

(30) Foreign Application Priority Data

Apr. 4, 2003 (IT) ..... BO2003A0200

(51) Int. Cl.
*F02M 55/02* (2006.01)

(52) U.S. Cl. ..... 123/468; 123/469

(58) Field of Classification Search ..... 123/456, 123/468, 469, 470, 472
See application file for complete search history.

(56) References Cited

U.S. PATENT DOCUMENTS 4,966,120 A * 10/1990 Itoh et al. ..... 123/516
5,014,654 A * 5/1991 Ishibashi ..... 123/184.38
5,630,466 A 5/1997 Garat et al. ..... 164/457
5,682,859 A * 11/1997 Wakeman ..... 123/470
6,338,333 B1 * 1/2002 Brosseau et al. ..... 123/456
6,405,711 B1 * 6/2002 Smith et al. ..... 123/456
6,427,755 B1 * 8/2002 Buckley ..... 164/132
6,564,856 B1 * 5/2003 Buckley ..... 164/132
2003/0015170 A1 1/2003 Klotz et al. ..... 123/306
2003/0051693 A1 * 3/2003 Vichinsky ..... 123/184.21
2004/0025848 A1 * 2/2004 Lee et al. ..... 123/470
2005/0188956 A1 * 9/2005 Moschini et al. ..... 123/456

FOREIGN PATENT DOCUMENTS

DE 42 24 908 2/1993
DE 199 20 195 11/2000

* cited by examiner

*Primary Examiner*—Carl S. Miller
(74) *Attorney, Agent, or Firm*—Baker & Daniels LLP

(57) ABSTRACT

A fuel manifold for the direct injection of fuel into an internal combustion engine comprising a head provided with a number of cylinders, a number of injectors, each of which is connected to the fuel manifold and is adapted directly to inject the fuel into a respective cylinder, and an intake manifold, which is connected to the head in order to supply fresh air to the cylinders, the fuel manifold being formed by a single monolithic body which is made from thixotropic aluminum by means of a pressure die casting process and comprises a supply duct adapted to distribute the fuel to the injectors, and a flange disposed laterally to the supply duct, the flange being adapted to be secured by a plurality of screws to the head of the engine and comprising a number of coupling members each of which is adapted to bring a respective cylinder into communication with the intake manifold.

8 Claims, 4 Drawing Sheets

FUEL MANIFOLD IN THIXOTROPIC ALUMINUM FOR THE DIRECT INJECTION OF FUEL INTO AN INTERNAL COMBUSTION ENGINE

The present invention relates to a fuel manifold for the direct injection of fuel into an internal combustion engine.

The present invention can be used particularly advantageously for the production of a fuel manifold for the direct injection of fuel into a fuel-driven internal combustion engine to which the following description will explicitly refer without going into detail.

BACKGROUND OF THE INVENTION

In recent years, fuel-driven internal combustion engines, in which the fuel is injected directly into the cylinders, have come to the fore; in these engines, the fuel is supplied under pressure to a fuel manifold connected to a series of injectors (one for each cylinder of the engine), which are actuated cyclically to inject part of the fuel under pressure in the fuel manifold into a respective cylinder.

In known engines with indirect fuel injection, the fuel manifolds are currently made from plastic material (typically moulded technopolymers) and are secured to the intake manifold, which is also generally made from plastic material, by means of a series of screws. Plastic material is easy to process and extremely economic, but does not have good mechanical properties and is not therefore able to bear the relatively high pressures of the fuel used in direct fuel injection with the necessary safety margins.

In order to ensure the necessary mechanical strength, it has been proposed to use fuel manifolds made from steel in known direct fuel injection engines; these fuel manifolds are nevertheless costly because of the number of machining and welding operations to which they have to be subject. It has also been proposed to use fuel manifolds made from cast aluminum by means of gravity die casting; these fuel manifolds are also costly as gravity die casting is a relatively slow production method, requires a large number of machining operations once the component has been removed from the casting mould and imposes minimum component thicknesses of no less than 4–5 mm.

SUMMARY OF THE INVENTION

The object of the present invention is to provide a fuel manifold for the direct injection of fuel into an internal combustion engine which is free from the drawbacks described above and is easy and economic to embody.

The present invention therefore relates to a fuel manifold for the direct injection of fuel into an internal combustion engine including a head provided with a plurality of cylinders and injectors, each of which is connected to the fuel manifold and adapted to directly inject fuel into the respective cylinder. An air intake manifold is connected to the head in order to supply fresh air to the cylinders. The fuel manifold is formed by a single monolithic body which is made of thixotropic aluminum by means of a pressure die casting process. The manifold includes a supply duct adapted to distribute the fuel under pressure to the injectors and a flange disposed laterally to the supply duct wherein the flange has a plurality of through holes in order to be secured to the head of the engine by respective screws and further comprises a plurality of coupling members, each of which is adapted to bringing a respective cylinder in communication with an intake manifold. The supply duct includes a main cylindrical tubular channel having two opposite open ends one of which is used to supply the fuel under pressure and the other is closed by a screw cap. In the vicinity of the end closed by the screw cap the main cylindrical tubular channel has a first opening adapted to receive a pressure regulator and a second opening adapted to receive a pressure sensor.

BRIEF DESCRIPTION OF THE DRAWINGS

The present invention will now be described with reference to the accompanying drawings, which show a non-limiting embodiment thereof, and in which.

DETAILED DESCRIPTION OF THE INVENTION

Figure 1:
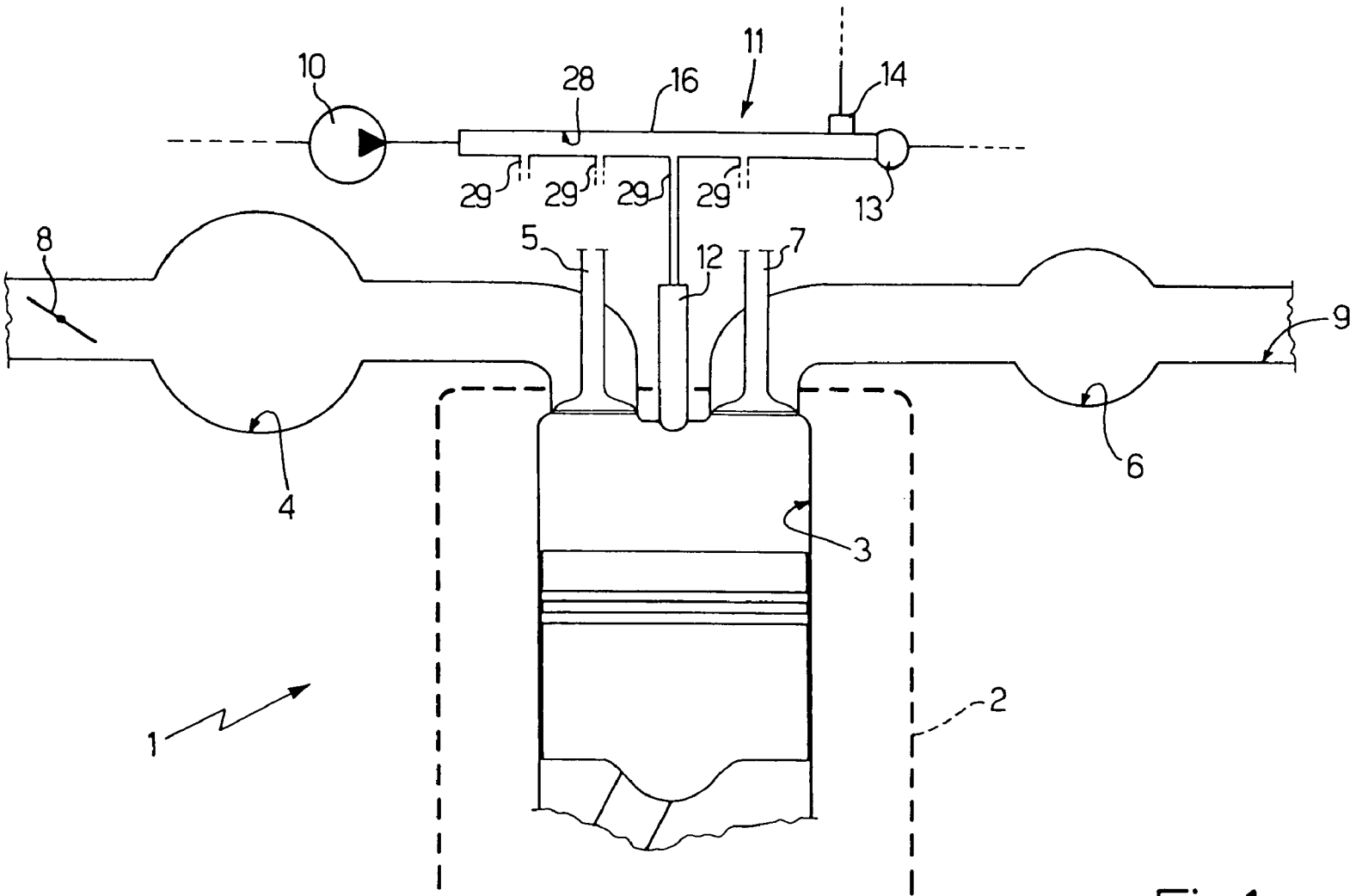
FIG. 1 is a diagrammatic view of an internal combustion engine with direct fuel injection provided with a fuel manifold in accordance with the present invention.

In FIG. 1, an internal combustion engine is shown overall by 1 and comprises a head 2 in which four cylinders 3 are provided (only one of which is shown in FIG. 1), each of these cylinders 3 being connected to an intake manifold 4 by means of at least one respective intake valve 5 and to an exhaust manifold 6 by means of a respective exhaust valve 7. The intake manifold 4 receives fresh air (i.e. ambient air from outside) by means of a butterfly valve 8 which can be adjusted between a closed position and a position of maximum opening; an exhaust duct 9 provided with one or more catalysts (not shown in detail) leads from the exhaust manifold 6 for the emission into the atmosphere of the gases generated by combustion in the cylinders 3.

A low pressure pump (not shown in detail) supplies the fuel from a tank (not shown in detail) to a high pressure pump 10 which in turn supplies the fuel to a fuel manifold 11; a series of injectors 12 (one for each cylinder 3) is connected to the fuel manifold 11, each of these injectors 12 being actuated cyclically to inject part of the fuel under pressure in the fuel manifold 11 into the respective cylinder 3. The pressure value of the fuel in the fuel manifold 11 is maintained instant by instant at a desired value by means of a pressure regulator 13 which is coupled to the fuel manifold 11 and is adapted to discharge any surplus fuel to a recycling duct which returns this surplus fuel upstream of the low pressure pump (not shown). A sensor 14, adapted to measure the pressure value of the fuel in the fuel manifold 11, is also connected to the fuel manifold 11.

Figure 2:
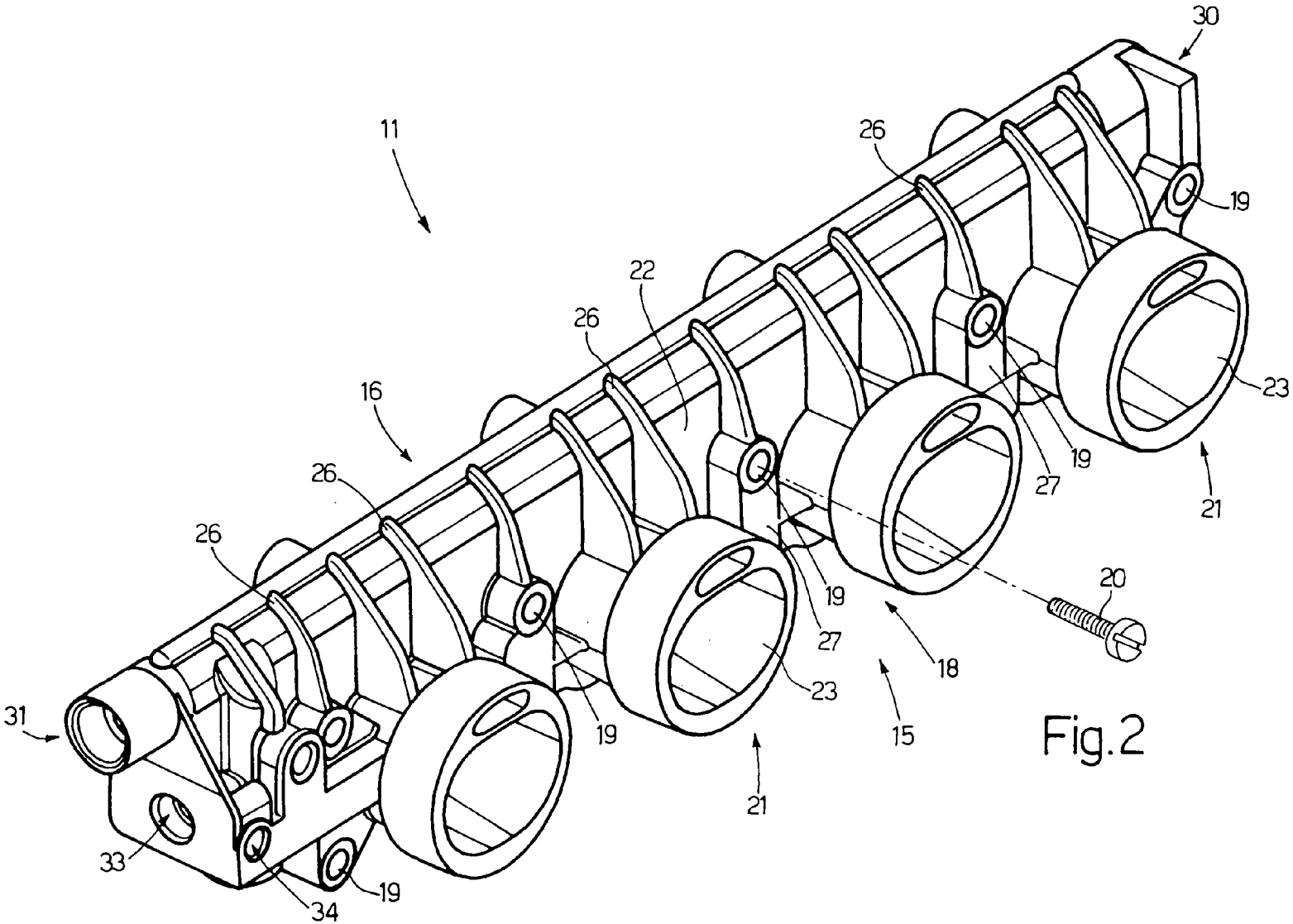
FIG. 2 is a perspective view of a preferred embodiment of the fuel manifold of FIG. 1.
Figure 3:
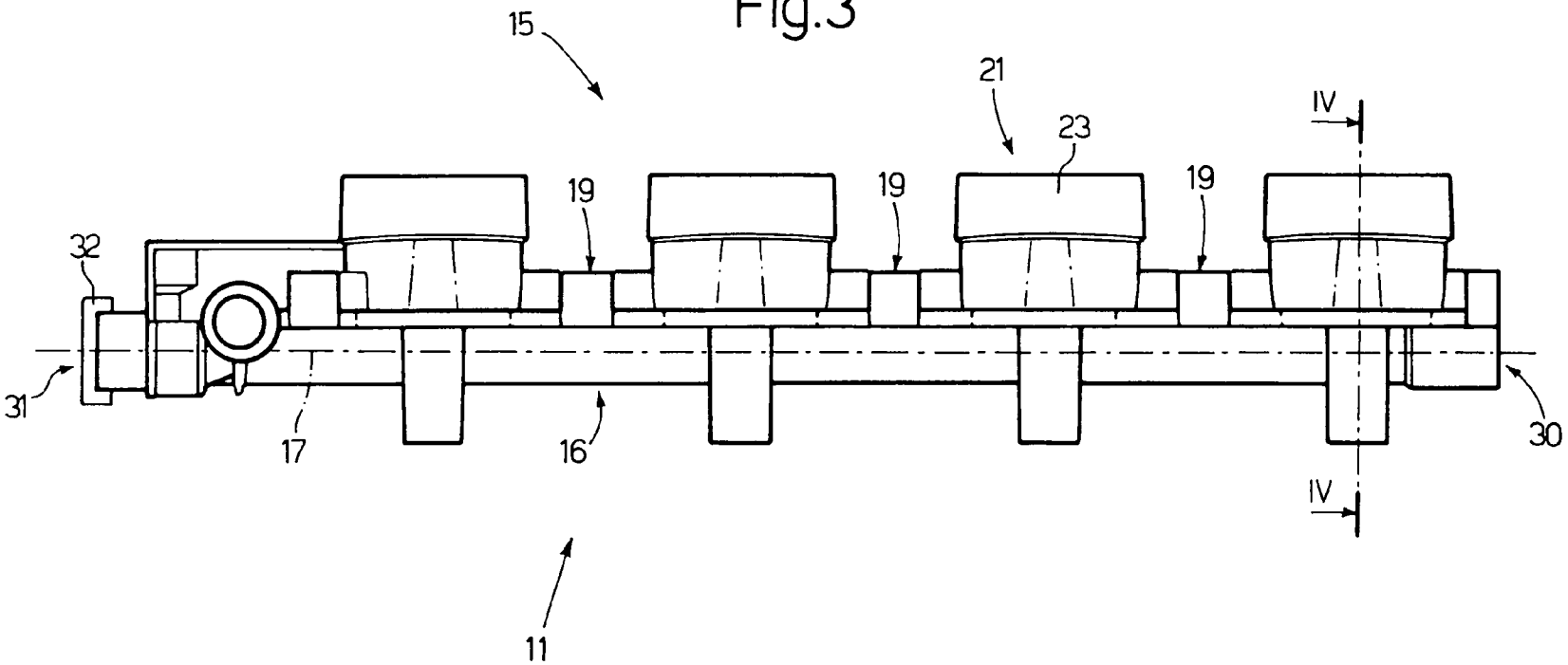
FIG. 3 is a front view of the fuel manifold of FIG. 2.
Figure 4:
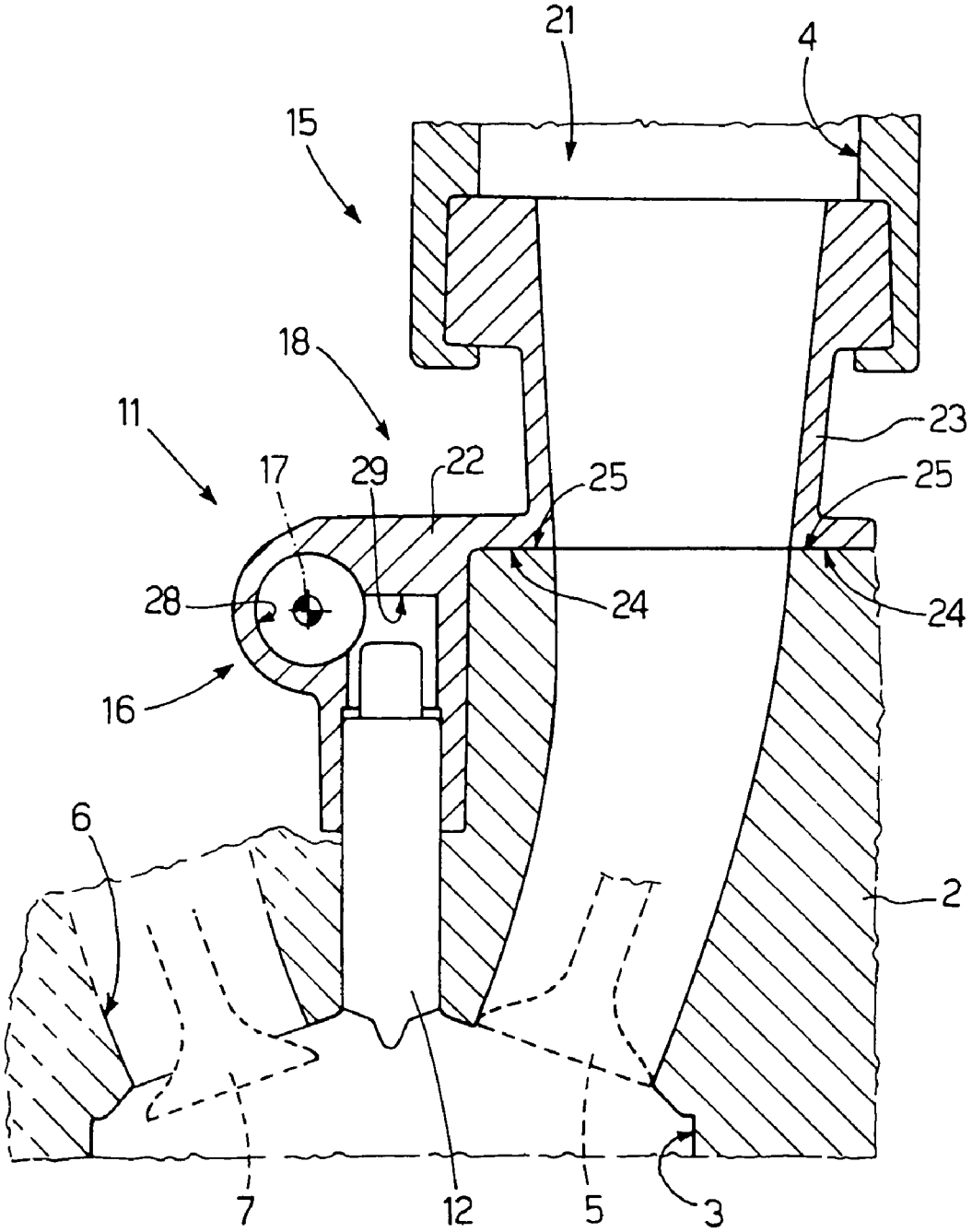
FIG. 4 is a view in section along the line IV—IV of the fuel manifold of FIG. 2 coupled to the head of the engine of FIG. 1.

As shown in FIGS. 2 to 4, the fuel manifold 11 is formed by a single monolithic body 15 which is made from thixotropic aluminum by means of a pressure die casting process and comprises a supply duct 16, which is of substantially cylindrical shape, has a central axis of symmetry 17 and is adapted to distribute the fuel under pressure to the injectors 12, and a flange 18 disposed laterally to the supply duct 16. The flange 18 has a plurality of through holes 19 so that it can be secured by respective screws 20 to the head 2 of the engine 1 and comprises four coupling members 21, each of which is adapted to bring a respective cylinder 3 into communication with the intake manifold 4.

The flange 18 comprises a substantially plane plate 22 which extends laterally to the supply duct 16 from a median portion of this supply duct 16; each coupling member 21 comprises a tubular body 23 which rises from the plate 22 in a perpendicular manner with respect to the plane in which the plate 22 lies. Preferably, the end upper portion of each tubular body 23 is shaped to facilitate connection with a respective duct coming from the intake manifold 4. A lower surface 24 of the plate 22, i.e. the opposite surface with respect to the tubular bodies 23, is plane and has a relatively very small surface roughness so that it can be coupled in a leak-tight manner (possibly with the interposition of a gasket) with a corresponding upper surface 25 of the head 2.

A series of reinforcing ribs 26, involving both the plate 22 and the supply duct 16, are provided and are disposed perpendicularly with respect to the plane in which the plate 22 lies and with respect to the axis 17 of the supply duct 16. The flange 18 has a series of raised zones 27, via each of which a respective through hole 19 is provided for the passage of a connection screw 20 with the head 2 of the engine 1. Part of the reinforcing ribs 26 starts from the raised zones 27, while the remaining part of the reinforcing ribs 26 starts from the tubular bodies 23.

As shown in FIG. 4, the supply duct 16 is formed by a main cylindrical tubular channel 28 from which a series of further secondary cylindrical tubular channels 29, disposed perpendicularly with respect to the main cylindrical tubular channel 28, leads; each secondary cylindrical tubular channel 29 is adapted to house a respective injector 12 in a leak-tight manner. The main cylindrical tubular channel 28 has two opposite open ends 30 and 31, the end 30 being connected to the high pressure pump 10 in order to supply the fuel under pressure to the fuel manifold 11, while the end 31 is closed by a relative screw cap 32. The function of the end 31 is to enable the correct production of the main cylindrical tubular channel 28 during the pressure die casting process for the monolithic body 15. In the vicinity of the end 31, the main cylindrical tubular channel 28 has an opening 33 adapted to receive the pressure regulator 13 and an opening 34 adapted to receive the pressure sensor 14. Preferably, the openings 33 and 34 are not formed during the pressure die casting process for the monolithic body 15, but are produced subsequently by drilling of the monolithic body 15.

What is claimed is:

1. A fuel manifold for the direct injection of fuel into an internal combustion engine comprising a head provided with a number of cylinders, a number of injectors, each of which is connected to the fuel manifold and is adapted directly to inject the fuel into a respective cylinder, and an intake manifold which is connected to the head in order to supply fresh air to the cylinders, wherein the fuel manifold is formed by a single monolithic body which is made of thixotropic aluminum by means of a pressure die casting process and comprises a supply duct adapted to distribute the fuel under pressure to the injectors, and a flange disposed laterally to the supply duct, the flange having a plurality of through holes in order to be secured by respective screws to the head of the engine and comprising a number of coupling members, each of which is adapted to bring a respective cylinder into communication with the intake manifold;

the supply duct includes a main cylindrical tubular channel having two opposite open ends, one of which is used to supply the fuel under pressure and the other is closed by a screw cap;

in the vicinity of the end closed by the screw cap, the main cylindrical tubular channel has a first opening adapted to receive a pressure regulator and a second opening adapted to receive a pressure sensor.

2. A fuel manifold as claimed in claim 1, in which the flange comprises a substantially plane plate which extends laterally to the supply duct from a median portion of this supply duct, each coupling member comprising a tubular body which rises from the plate perpendicularly with respect to the plane in which said plate lies.

3. A fuel manifold as claimed in claim 2, in which a lower surface of the plate is planar and has a relatively very small surface roughness so that is can be coupled in a leak-tight manner with a corresponding upper surface of the head.

4. A fuel manifold as claimed in claim 2, in which a series of reinforcing ribs are provided and are disposed perpendicularly with respect to the plane in which the plate lies and are on both the plate and the supply duct.

5. A fuel manifold as claimed in claim 4, in which the flange has a series of raised zones, via each of which a respective through hole is provided for the passage of a screw for connection to the head of the engine.

6. A fuel manifold as claimed in claim 5, in which some reinforcing ribs start from the raised zones.

7. A fuel manifold as claimed in claim 4, in which some reinforcing ribs start from the tubular bodies.

8. A fuel manifold as claimed in claim 1, in which the supply duct is formed by a main cylindrical tubular channel from which a series of further secondary cylindrical tubular channels, disposed perpendicularly with respect to the main cylindrical tubular duct, lead, each said secondary cylindrical tubular channel being adapted to house a respective injector in a leak-tight manner.

* * * * *

UNITED STATES PATENT AND TRADEMARK OFFICE

CERTIFICATE OF CORRECTION

PATENT NO. : 7,213,575 B2
APPLICATION NO. : 10/817221
DATED : May 8, 2007
INVENTOR(S) : Renzo Moschini et al.

It is certified that error appears in the above-identified patent and that said Letters Patent is hereby corrected as shown below:

Claim 3, Column 4, Line 28, delete "is" and insert --it--

Signed and Sealed this

Fourth Day of September, 2007

JON W. DUDAS
*Director of the United States Patent and Trademark Office*